US005560160A

United States Patent [19]

Vladikovic

[11] Patent Number: 5,560,160

[45] Date of Patent: Oct. 1, 1996

[54] FLYING FORM TABLE TRUSS AND SCREW JACK LEG THEREFOR

[76] Inventor: Peter Vladikovic, 2743 W. 37th Ave., Vancouver, British Columbia, Canada, V6N 2T5

[21] Appl. No.: 8,132

[22] Filed: Jan. 25, 1993

[51] Int. Cl.[6] ..... F04G 11/48; F04G 11/38

[52] U.S. Cl. ..... 52/126.6; 182/184; 248/354.3; 248/357; 249/18; 249/210; 254/100; 254/DIG. 4

[58] Field of Search ..... 249/18, 24, 28, 249/29, 188, 210, 212; 52/690, 126.5, 126.6, 127.1, 127.2, 126.7, 169.9, 169.12, 299, 693; 182/182, 183, 184; 248/650, 357, 354.3, 188.2, 188.4; 254/11, 13, 43, 44, 96, 98, 100, 101, 133 A, DIG. 4

[56] References Cited

U.S. PATENT DOCUMENTS

| | | | |
|---|---|---|---|
| 813,318 | 2/1906 | McCarthy | 248/357 |
| 1,325,951 | 12/1919 | Malicki | 254/DIG. 4 |
| 1,388,836 | 8/1921 | Ripsch et al. | 254/DIG. 4 |
| 1,541,306 | 6/1925 | Young | 254/133 R |
| 1,646,725 | 10/1927 | Davidson | 248/357 |
| 3,917,214 | 11/1975 | Ratcliff et al. | 249/18 |
| 3,977,536 | 8/1976 | Moore et al. | 249/18 |
| 4,036,466 | 7/1977 | Van Meter | 249/210 |
| 4,106,256 | 8/1978 | Cody | 249/28 |
| 4,546,581 | 10/1985 | Gustafson | 52/169.9 |
| 4,831,797 | 5/1989 | Vladikovic | 52/126.6 |
| 4,866,797 | 9/1989 | Vollan | 52/126.6 |
| 4,882,887 | 11/1989 | Giles et al. | 254/100 |
| 4,937,989 | 7/1990 | Miyares et al. | 52/126.6 |

FOREIGN PATENT DOCUMENTS

| | | | |
|---|---|---|---|
| 511862 | 6/1952 | Belgium | 248/357 |

*Primary Examiner*—Michael Safavi

[57] ABSTRACT

A flying form table truss having web members interconnecting top and bottom chords includes screw jack legs adjustable independently of the web members along the bottom chord. Each screw jack leg has a screw jack and a ground engagement member at one end of the screw jack leg, and is connected by a pivot connection to a readily releasible fastening mechanism provided at the opposite end of the screw jack for securing the screw jack leg to the bottom chord. The fastening mechanism comprises at least one fastener for tightening the fastening mechanism against the bottom chord to secure the screw jack leg in position on the bottom chord.

4 Claims, 4 Drawing Sheets

FLYING FORM TABLE TRUSS AND SCREW JACK LEG THEREFOR

BACKGROUND OF THE INVENTION

1. Field of the Invention

The present invention relates to flying form table trusses for supporting cast in place concrete used, for example, for multiple slab areas, wide bays and multilevel building construction, and the invention further relates to screw jack legs for use in such trusses.

2. Description of Related Art

Flying shoring forms, which are used extensively for the above-mentioned purposes, are commonly referred to as flying form tables and are formed of a pair of parallel trusses, with bracing between the trusses, and with screw jack legs for supporting the trusses.

In use, a deck is supported on the tops of the trusses and is used to support concrete during the casting of a concrete slab. After the concrete has hardened, the flying form tables are lowered from the hardened concrete, and are then rolled outwardly from beneath the hardened concrete slab, so that they can be subsequently lifted by a crane, as if they were flying, and transported to the next slab casting area.

In conventional flying form tables, the trusses are constructed as elements of a fixed size, weight and construction, and are generally of a modular nature, which in practice predetermines the length of the tables in increments of approximately six feet to ten feet. The trusses of these conventional flying form tables are provided with support legs, in the form of screw jacks, which have predetermined, fixed locations on the bottoms of the trusses, irrespective of the shape of the concrete floor or other support upon which they bear during the casting operation.

In order to improve the adaptability of such an conventional flying form table trusses, the present inventor has developed an improved truss structure, which is disclosed in U.S. Pat. No. 4,831,797, issued May 23, 1989 to the present inventor, the disclosure of which is incorporated herein by reference.

The truss structure disclosed in the above-mentioned prior patent is formed of upper and lower chords, which are connected by rigid web members in the form of A frames, which are adjustable in position along the top and bottom chords. The contractor using the truss is, therefore, able to increase or decrease the spaces between the A-frames, depending on the thickness of the concrete slab to be cast, and can vary the lengths of his tables in increments of one foot.

The trusses employing these adjustable A-frames can therefore be assembled so as to match the requirements of individual projects, so that the user is provided with a flying form table which is tailor-made for his individual projects, and which avoids unnecessary materials and overhead costs.

BRIEF SUMMARY OF THE INVENTION

It is an object of the present invention to provide an improved flying form table truss having web members interconnecting top and bottom chords and incorporating a screw jack leg which can be adjusted along the bottom chord independently of the web members.

According to the present invention, the leg comprising a screw jack having a ground engagement member at one end of the screw jack and a readily releasible fastening mechanism at the opposite end of the screw jack, for securing the screw jack leg to the bottom chord. The fastening mechanism comprises at least one friction member for frictional engagement with the bottom chord, and a fastener for tightening the friction member against the bottom chord to secure the screw jack leg in position on the bottom chord.

With this arrangement, the screw jack leg can be readily moved, relating to the web members to and fro along the bottom chord, to a desired operative position, and then can be fastened in that position. Consequently, the truss can be readily adapted so as to be supported on underlying surfaces, for example the tops of concrete slabs of different dimensions. The truss can therefore be cantilevered beyond the edge of a supporting concrete slab, with the screw jack being positioned on the concrete slab, at a location close to the edge of the slab, so as to optimize the support provided by the screw jack leg to the cantilevered portion of the truss.

In the preferred embodiment of the invention, the bottom chord is formed, at opposite sides thereof, with laterally outwardly extending projections in the form of flanges. The fastening mechanism, in this case, comprises upper and lower friction plate members, which are in slidable engagement with the upper and lower flanges, respectively, to allow the displacement of the screw jack leg along the bottom chord, and a wedging mechanism for urging the upper and lower friction members against the upper and lower flanges for securing the screw jack leg in position relative to the bottom chord.

BRIEF DESCRIPTION OF THE DRAWING

Further features, objects and advantages of the present invention will be more readily apparent from the following description thereof when taken in conjunction with the accompanying drawing, in which.

DESCRIPTION OF THE PREFERRED EMBODIMENT

Figure 1:
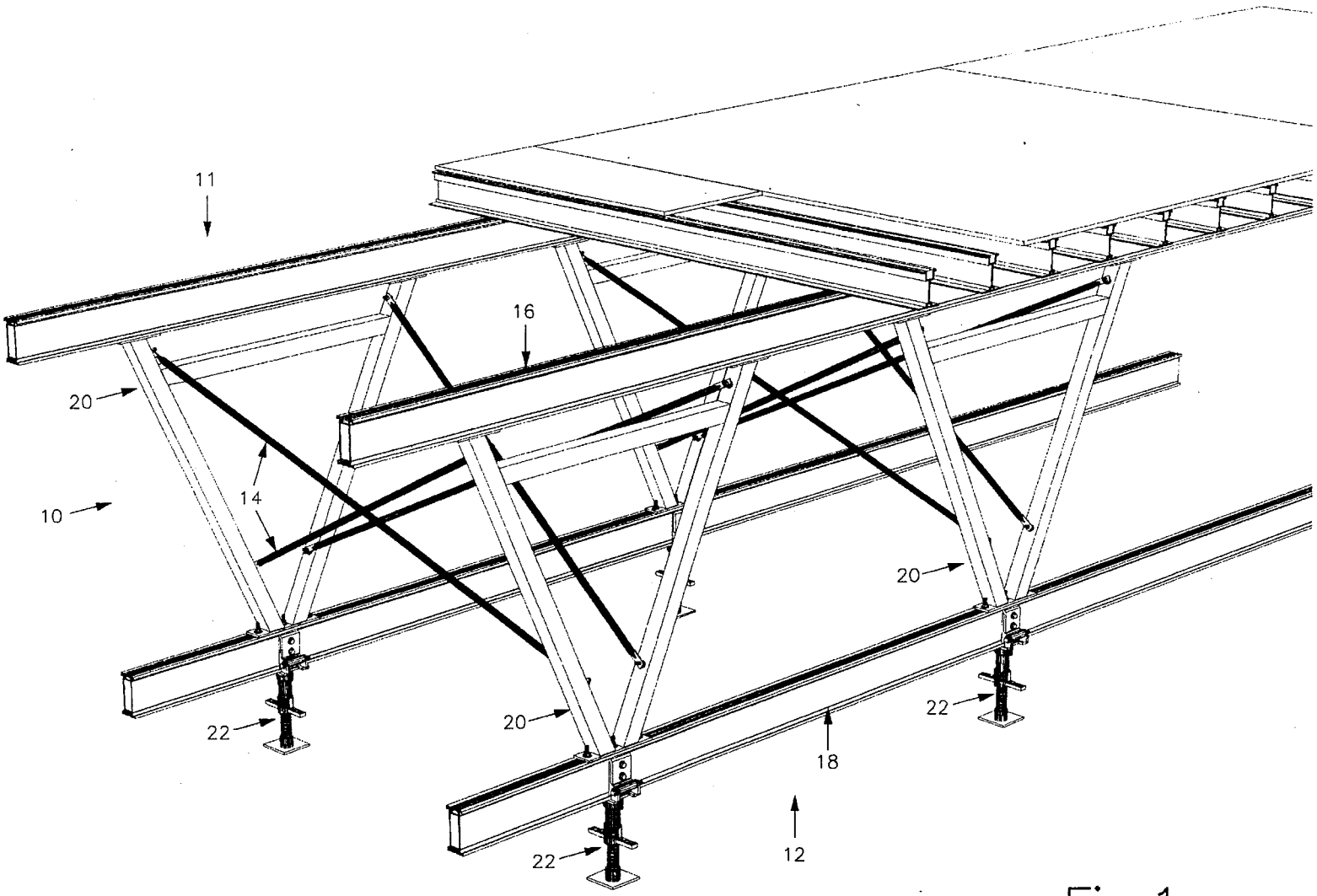
FIG. 1 shows a view in perspective, of a flying form table according to the present invention.

The flying form table illustrated in FIG. 1 and indicated generally by reference numeral 10 has a pair of parallel trusses, indicated by reference numerals 11 and 12, which are connected together by braces 14.

Each of the trusses 11 and 12 is formed by a top chord 16, a bottom chord 18 and a plurality of A-frames, indicated generally by reference numerals 20. The bottom chords 18 are supported on screw jack legs indicated generally by reference numerals 22.

As described in greater detail below, the screw jack legs 22 are adjustable in position along the bottom chords 18.

Figure 3:
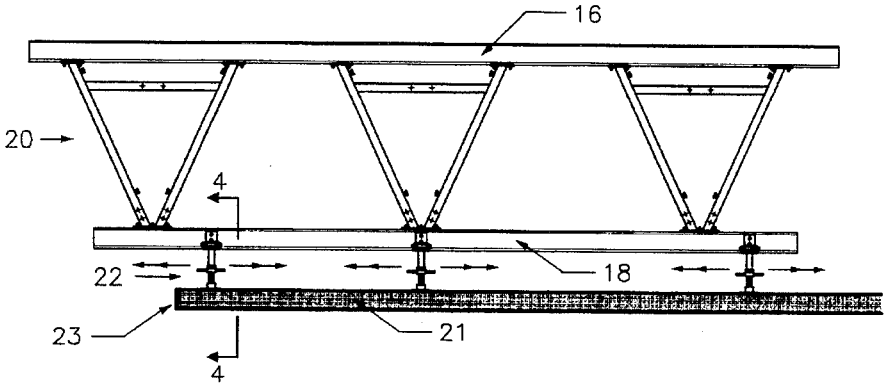
FIG. 3 shows a view corresponding to that of FIG. 2, but illustrating the flying form table of FIG. 1.
Figure 2:
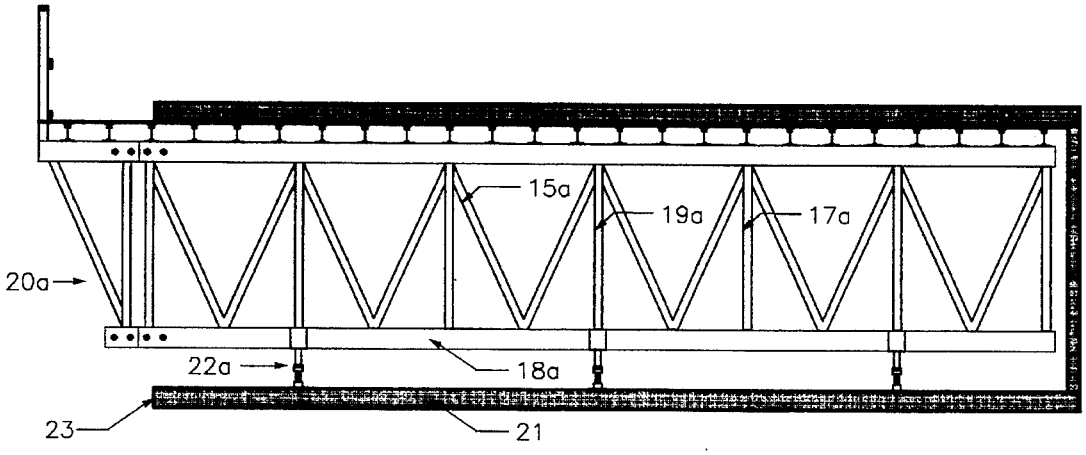
FIG. 2 shows a view in side elevation of a prior art flying form table in use in the construction of a building.

The advantage of such adjustment of the screw jack legs 22 is apparent from consideration of the prior art truss which is illustrated in FIG. 2, and indicated generally by reference numeral 20*a*, and the truss 20 of the present flying form table 10 shown in FIG. 3.

The prior art truss 20*a* illustrated in FIG. 2 has top and bottom chords 16*a* and 18*a* which are connected by web members 15*a*, 17*a* and 19*a*, which are fixed to the chords 16*a* and 18*a*. This prior art truss 20*a* is supported on legs 22*a* which are fixed to the bottoms of the chords 18*a* so that the horizontal distance between the screw jack legs 20*a* is pre-set during manufacture of the truss at a factory and therefore cannot be adjusted, at a constructions site, in order to adapt the truss 20*a* to the dimensions of a concrete slab 21, on which the truss 20*a* is supported.

Consequently, the left hand one of the screw jack legs 22*a*, as illustrated in FIG. 2, must in this example be spaced a considerable distance inwardly from the outer edge 23 of the slab 21.

Referring now to FIG. 3, it will be apparent that, in contrast to the conventional truss 20*a* as illustrated in FIG. 2, the present truss 20 has the advantage that, since the screw jack legs 22 can be adjusted in position along the bottom chord 18, they can be adjusted in position in accordance with the dimensions of the underlying supporting concrete slab 21. Consequently, the left hand screw jack leg 22, as viewed in FIG. 3, can be located close to the concrete slab edge 23. Also, the A-frames 20 are adjustable in position along the chords 16 and 18, in accordance with the thickness and other dimensions of the concrete being cast, and the screw jack legs 22, can be correspondingly adjusted in position along the length of the bottom chord 18 so as to underlie respective ones of the A-frames 20.

Figure 6:
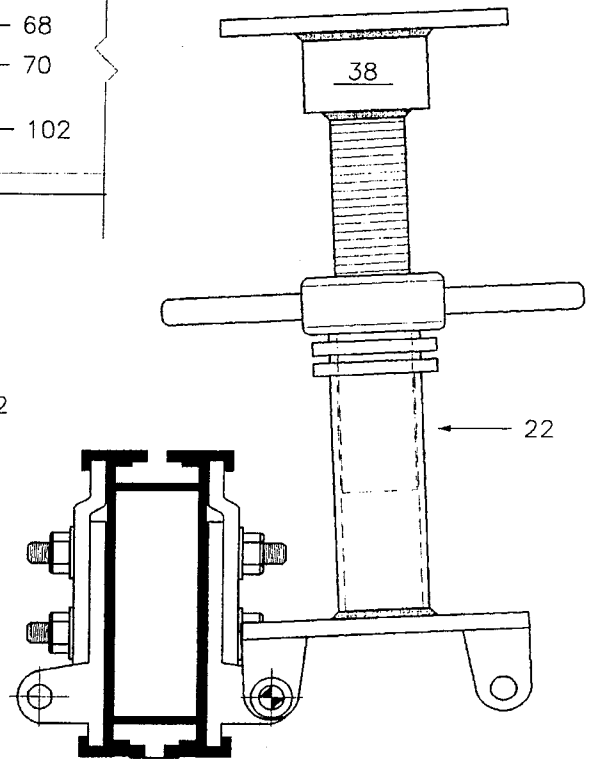
FIG 6 shows a view corresponding to that of FIG. 4 but with the screw jack of the leg pivoted upwardly into an inoperative position.
Figure 5:
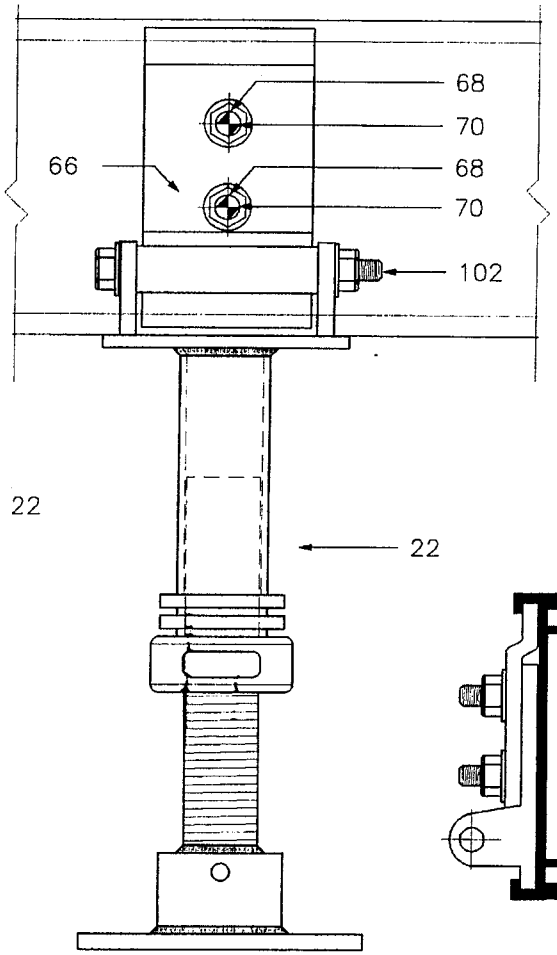
FIG. 5 shows a view in side elevation of the screw jack leg of FIG. 4.
Figure 4:
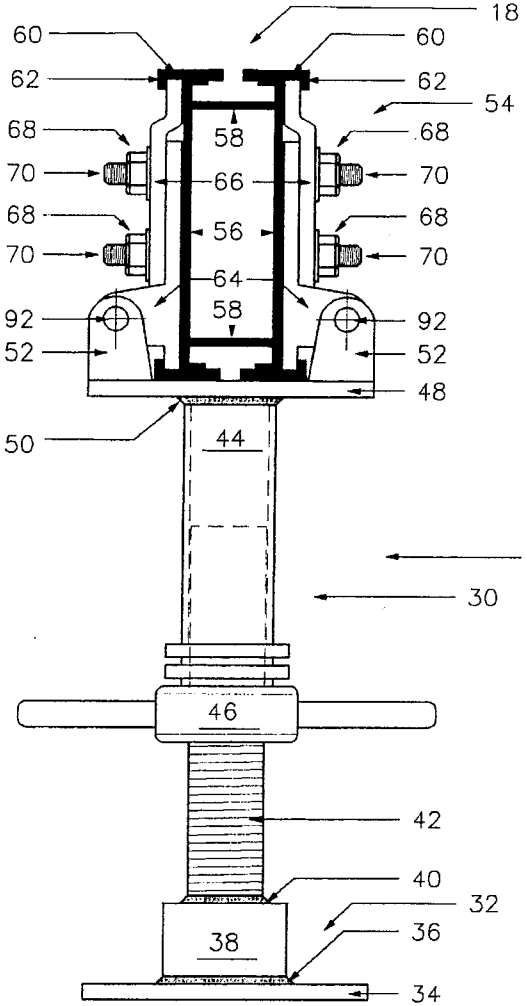
FIG. 4 shows a view of a screw jack leg according to the present invention taken in partial section through FIG. 3 along the line 4—4.

Referring now to FIGS. 4 through 6, which illustrate in greater detail one of the screw jack legs 22, it will be seen that the screw jack leg illustrated therein has a screw jack, indicated generally by reference numeral 30, which is provided at its bottom end with a ground engagement member indicated generally by reference numeral 22. The ground engagement member 32 comprises a plate 34 secured by a weld 36 to a sleeve 38, which is in turn secured by a weld 40 to a threaded shaft 42.

The threaded shaft 42 is received, at it upper end, in a tube 44, which rests on a nut 46 and the nut 46 is in threaded engagement with the threaded shaft 42.

A horizontal plate 48 is secured by a weld 50 to the upper end of the tube 44, and a pair of lugs 52 are welded to the top surface of the plate 48.

The plate 48 and the lugs 52 form parts of a fastening mechanism, indicated generally by reference numeral 54, which serves to releasibly secure the screw jack leg 22 to the bottom chord 18.

As shown in FIG. 4, the bottom chord 18, which is in the form of an aluminum extrusion, has opposite vertical side webs 56, with top and bottom horizontal webs 58 extending between the webs 56.

The side webs 56 extend vertically beyond the horizonal webs 56, and are formed with horizontal flanges 60, which extends laterally of the bottom chord 18 beyond the side webs 56. The outer ends of the flanges 60 are formed with edge portions 62 extending at right angle to the flanges 60.

Each fastening mechanism 54 also includes a pair of friction plate members 64 and 66, which are connected to one another by a pair of nuts 68 and a pair of bolts 70.

Figure 7:
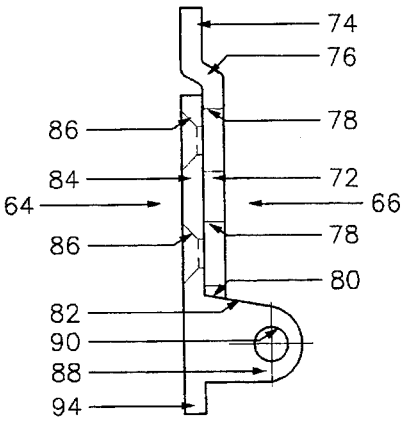
FIG. 7 shows a view in side elevation of upper and lower friction members forming part of the leg of FIGS. 4–6.
Figure 8:
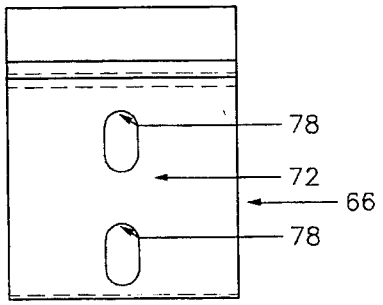
FIG. 8 shows a view in elevation, taken in the direction of the arrow A of FIG. 7, and showing one of the friction members of FIG. 7.

The friction plate members 64 and 66 are shown in greater detail in FIGS. 7 and 8.

Referring to FIGS. 7 and 8, it will be seen that the friction plate member 66 comprises a major flat portion 72, which has an upper edge portion 74 offset from the portion 72 and connected to the portion 72 by an intermediate portion 76. A pair of elongate holes 78 are formed in the flat portion 66 for receiving the bolts 70. The bottom edge of the friction plate member 66 is formed with an inclined, wedge surface 80 which abuts a complementary wedge surface 82 on the friction plate member 64.

The friction plate member 64 is formed by a plate-shaped portion 84, which is penetrated by a pair of counter-bored through-openings 86 for receiving the heads of the bolts 70, with the shanks of the bolts 70 extending through the openings 78. The friction plate member 64 also has a laterally extending projection 88 formed with a boring 90 which, in the assembled screw jack leg 22, as shown in FIG. 4, is aligned with corresponding cylindrical openings 92 in the lugs 52.

The bottom of the plate portion 84 of the friction plate member 64 is formed as an edge portion 94 which, as shown in FIG. 4, is dimensioned, so as to be received in snug sliding engagement between the bottom chord side wall 56 and the edge portion 62 at the bottom of the bottom chord 18. The edge portion 74 of the friction plate member 66 is similarly snugly slidably received between the bottom chord side wall 56 and the flange edge portion 62 at the top of the bottom chord 18.

When the nuts 68 are loosened on the bolts 70, the friction plate members 64 and 66 are free to slide along the bottom chord side walls 56 and the flanges 60, so as to enable the screw jack leg to be adjustably positioned along the bottom chord 18, as described above. When the screw jack leg 18 has been thus located in its desired, operational position, the nuts 68 are tightened on the bolts 70, thus causing a wedging action between the surfaces 80 and 82 of the friction plate members 66 and 64. This wedging action causes the friction plate members 64 and 66 to be displaced, relative to one another, towards their respective bottom chord flanges 60 and into tight frictional engagement with these flanges 60, thus securing the screw jack leg 22 in position on the bottom chord 18.

The elongate bolt holes 78 formed in the friction plate member 66 facilitate the relative longitudinal movement of the friction plate member 64 and 66.

When it is desired to readjust the position of the screw jack leg 22, the nuts 68 are again slackened, so as to release the edge portions 74 and 94 of the friction plate members 64 and 66 from their tight engagement with the flanges 60.

When it is desired to remove the truss, a locking pin is removed from one of the openings 90 and the corresponding openings 92, so that the screw jack can pivot about a bolt 102 extending through the other opening 90 and the corresponding openings 92. The screw jack 30 can thus be pivoted upwardly into the position in which it is shown in FIG. 6.

Figure 9:
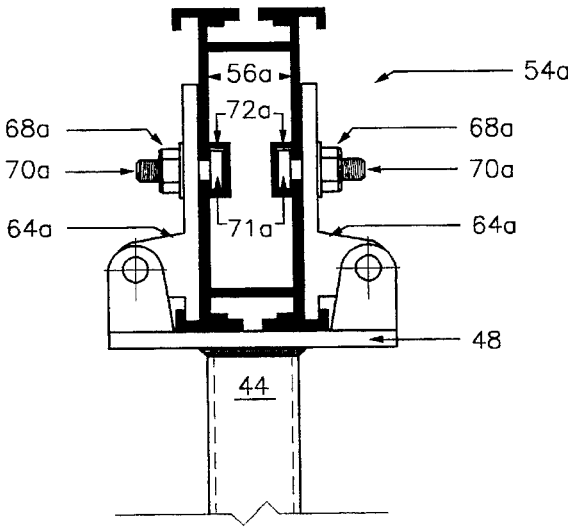
FIGS. 9 and 10 show views corresponding to FIG. 4 but of two modified screw jack legs.
Figure 10:
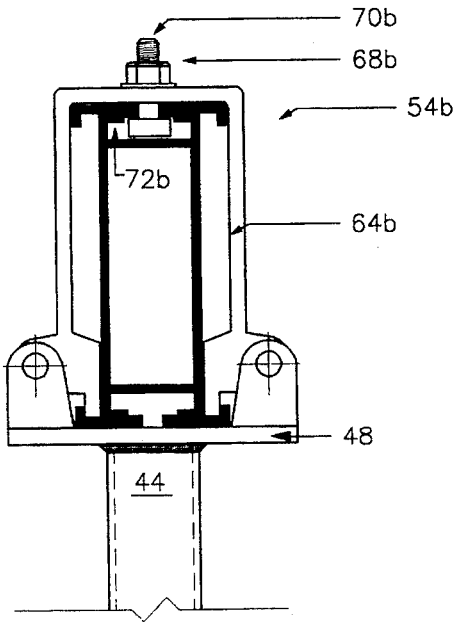

FIGS. 9 and 10 show two modifications of the fastener 54, which are indicated generally by reference numerals 54*a* and 54*b*.

The fastener 54*a* has, at each side of the bottom chord, only a single friction member 64*a*, which is tightened against the respective side wall 65 of the bottom chord by a nut 68*a* and a bolt 70*a*, which has a head 71*a* received in a longitudinal recess 72*a* in the side wall 56.

The fastener 54*b* has a single, generally U-shaped friction member 64*b* which extends, as shown, over the top of the bottom chord 18, to which it is tightened by a nut 68*b* and a bolt 70*b* having a head 71*b* received in a longitudinal recess 72*b* in the top of the bottom chord 18.

I claim:

1. A flying form table truss, comprising:

top and bottom chords;

web members connecting said top and bottom chords; and legs for supporting said truss;

said legs being slidable along said bottom chord relative to said web members and each having a readily releasible fastening mechanism for adjustably securing the respective leg in position on said bottom chord;

said legs each including a screw jack; a pivot connection pivotally connecting an upper end of said screw jack to said fastening mechanism and a locking member for releasably locking said fastening mechanism in an operative position relative to said screw jack;

said fastening mechanism including a readily releasible fastener means for tightening said fastening mechanism into frictional engagement with said bottom chord; and said fastening mechanism being separate from said web members and being slidable to and fro along said bottom chord, independently of said web members, on release of said fastener means.

2. A flying form table truss as claimed in claim 1, wherein:

said bottom chord has opposite sides each having upper and lower projections extending laterally outwardly of said bottom chord;

said fastening mechanism comprising, at each of said opposite sides, a pair of friction plate members slidably engaging said upper and lower projections, respectively, to allow displacement of the respective leg along said bottom chord; and said fastener means urging said friction plate members against said upper and lower projections for securing the respective one of said legs in position relative to said bottom chord.

3. A flying form table truss as claimed in claim 2, wherein said friction plate members comprise relatively displaceable upper and lower friction members, said fastening mechanism further comprising wedge means for displacing said upper and lower friction plate members against said upper and lower projections, respectively.

4. A flying form table truss as claimed in claim 2, wherein said fastening mechanism comprises a wedge mechanism which is adjustable to force said fastening mechanism into frictional engagement with said bottom chord.

* * * * *